US007238235B2

(12) United States Patent
Bhattacharya et al.

(10) Patent No.: US 7,238,235 B2
(45) Date of Patent: Jul. 3, 2007

(54) ADHESION PROMOTER APPLICATION SYSTEM AND PROCESS

(75) Inventors: Shubho Bhattacharya, Columbus, OH (US); Laura McBride, Powell, OH (US); Yoshihiro Yamamoto, West Bloomfield, MI (US); Shojiro Takeuchi, FRACC Providencia Jal (MX); Saul Gonzalez Gutierrez, Parques Colon Zapopan Jal (MX)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/286,465

(22) Filed: Nov. 23, 2005

(65) Prior Publication Data

US 2006/0075962 A1 Apr. 13, 2006

Related U.S. Application Data

(60) Continuation of application No. 10/675,183, filed on Sep. 30, 2003, now abandoned, which is a division of application No. 09/577,776, filed on May 24, 2000, now abandoned.

(51) Int. Cl.
*B05B 7/06* (2006.01)

(52) U.S. Cl. ..... 118/315; 118/64; 118/66

(58) Field of Classification Search ..... 118/667, 118/679, 683, 684, 686, 708, 712, 603, 610, 118/73, 315, 326, 64, 66, 69
See application file for complete search history.

(56) References Cited

U.S. PATENT DOCUMENTS

| | | | | |
|---|---|---|---|---|
| 3,559,619 A | | 2/1971 | Johnson | 118/104 |
| 4,214,962 A | | 7/1980 | Pincon | 204/157.1 R |
| 4,367,787 A | | 1/1983 | Bradshaw | 165/35 |
| 4,452,171 A | | 6/1984 | Browning | 118/58 |
| 4,600,608 A | | 7/1986 | Ankrett | 427/424 |
| 4,923,121 A | | 5/1990 | Boyer | 239/434.5 |
| 4,992,216 A | | 2/1991 | Saita et al. | 261/122 |
| 5,023,116 A | | 6/1991 | Williams et al. | 427/424 |
| 5,094,183 A | * | 3/1992 | Hamasaki | 118/56 |
| 5,230,739 A | | 7/1993 | Bartow | 118/694 |
| 5,335,682 A | | 8/1994 | Yoshimura et al. | 134/72 |
| 5,482,745 A | | 1/1996 | Cuellar et al. | 427/421 |

(Continued)

FOREIGN PATENT DOCUMENTS

EP 0 517 471 A2 12/1992

(Continued)

*Primary Examiner*—Brenda A. Lamb
(74) *Attorney, Agent, or Firm*—Standley Law Group LLP

(57) ABSTRACT

A system and method for applying a material for improving the adhesion between the surface of thermoplastic polyolefin (TPO) elements and a coating applied thereto is disclosed. The system comprises the mixing of an adhesion promoter with de-ionized water and applying it to the surface of the TPO elements to be coated. Preferably, the application occurs in an atmospherically controlled enclosure. The application of the adhesion promoter is preferably accomplished by flowing the mixture over the TPO elements through an application device that minimizes agitation and splashing of the mixture. Multiple parameters of the application system may be monitored and regulated. Upon completion of the application process, the treated TPO elements are preferably dried in an oven, leaving a thin layer of adhesion promoter over the surface thereof. Use of the application device ensures that minimal defects are present in the dried adhesion promoter layer.

11 Claims, 7 Drawing Sheets

U.S. PATENT DOCUMENTS

| | | | | |
|---|---|---|---|---|
| 5,534,297 | A | 7/1996 | Ogisu et al. | 427/322 |
| 5,575,560 | A | 11/1996 | Kaneski et al. | 366/219 |
| 5,709,946 | A | 1/1998 | Jackson et al. | 428/413 |
| 5,709,947 | A | 1/1998 | Hodgkin et al. | 428/413 |
| 5,863,333 | A | 1/1999 | Kato et al. | 118/315 |
| 5,919,288 | A | 7/1999 | Mashima et al. | 95/155 |
| 5,932,357 | A | 8/1999 | Coates et al. | 428/483 |
| 6,262,160 | B1 | 7/2001 | Kawano et al. | 524/378 |
| 6,447,844 | B1 | 9/2002 | Kawano et al. | 427/302 |

FOREIGN PATENT DOCUMENTS

| | | |
|---|---|---|
| WO | WO 97/31694 | 9/1997 |
| WO | WO 97/47678 | 12/1997 |

* cited by examiner

ADHESION PROMOTER APPLICATION SYSTEM AND PROCESS

CROSS-REFERENCE TO RELATED APPLICATIONS

This application is continuation of application Ser. No. 10/675,183, filed Sep. 30, 2003 now abandoned, is a divisional of application Ser. No. 09/577,776, filed May 24, 2000 now abandoned. Said applications are expressly incorporated herein by reference.

BACKGROUND AND SUMMARY OF THE INVENTION

Environmental concerns have led to an attempted reduction of pollutants from a multitude of sources. Manufacturing facilities, have been required to operate under increasingly stringent emissions guidelines. These emissions guidelines require, in part, a reduction of volatile organic compound (VOC) emissions.

In a manufacturing environment, VOC's have a wide variety of uses. For example, certain VOC's have been commonly employed for the purpose of cleaning and preparing various plastic components for receiving a material coating, such as paint. More specifically, such VOC's are particularly useful for cleaning and preparing thermoplastic polyolefin (TPO) components for coating with a primer or paint product. Not only are such VOC's effective for the removal of grease and other contaminants which may reside on these components, they also act on the surface of the TPO to promote adhesion with the forthcoming primer or paint coating.

In an attempt to reduce emissions, it has become essential to drastically reduce or eliminate the use of VOC's. For similar reasons, most automobile manufacturers also now employ a water-based paint and/or primer rather than traditional solvent-based products.

New plastic formulations have been developed which may be cleaned via non-VOC methods, and which are better able to bond with water-based paint and/or primer. However, TPO exhibits inherently poor wettability—meaning that it tends to repel moisture. Without the use of trichloroethylene or similar materials to prepare the surface, providing adequate paint adhesion is of great concern. For this reason, manufacturers utilizing a water-based cleaning system and water-based paint, typically provide the TPO components with a primer coat prior to the final paint or color coat.

Unfortunately, primer coating is a costly process. One reason is that a large portion of the sprayed primer is typically lost rather than deposited on the component. Additionally, once the components have received a primer coat, it is generally necessary to cycle them through an oven to allow the primer to fully dry. Therefore, it is desirous to develop a system and method that will allow a paint coating to be applied directly to the surface of a TPO component, without the need to first apply a coat of primer.

The present invention satisfies this need. The system and method of the present invention applies a water-based adhesion promoter to each TPO component. The adhesion promoter application preferably occurs after the component has undergone a cleaning process. After the adhesion promoter is applied and dried, a thin layer will remain on the surface of the TPO component. This thin layer of adhesion promoter is sufficient to provide the necessary adhesion between the component and the forthcoming paint coat.

The adhesion promoter application system of the present invention may monitor a variety of parameters during operation, including, for example: line speed of the component; temperature of the component; temperature of the adhesion promoter; adhesion promoter nozzle distance and angle; adhesion promoter flow rate; nozzle spray pattern; setting zone time, temperature and relative humidity; and pre-oven and oven time, temperature and relative humidity. The adhesion promoter application system of the present invention may also be adapted to distinguish when a part is present within the system and to provide periodic water flushing in order to prevent adhesion promoter build-up.

Therefore, the adhesion promoter application system of the present invention allows a paint coat to be applied to the surface of a TPO component without the need to first apply a primer coat. As such, the present invention may provide a reduction in material, equipment and labor costs, as well as an increase in production capacity.

BRIEF DESCRIPTION OF THE DRAWINGS

In addition to the novel features and advantages mentioned above, other objects and advantages of the present invention will be readily apparent from the following descriptions of the drawings and embodiments, wherein.

DETAILED DESCRIPTION OF THE EMBODIMENT(S)

Figure 1:
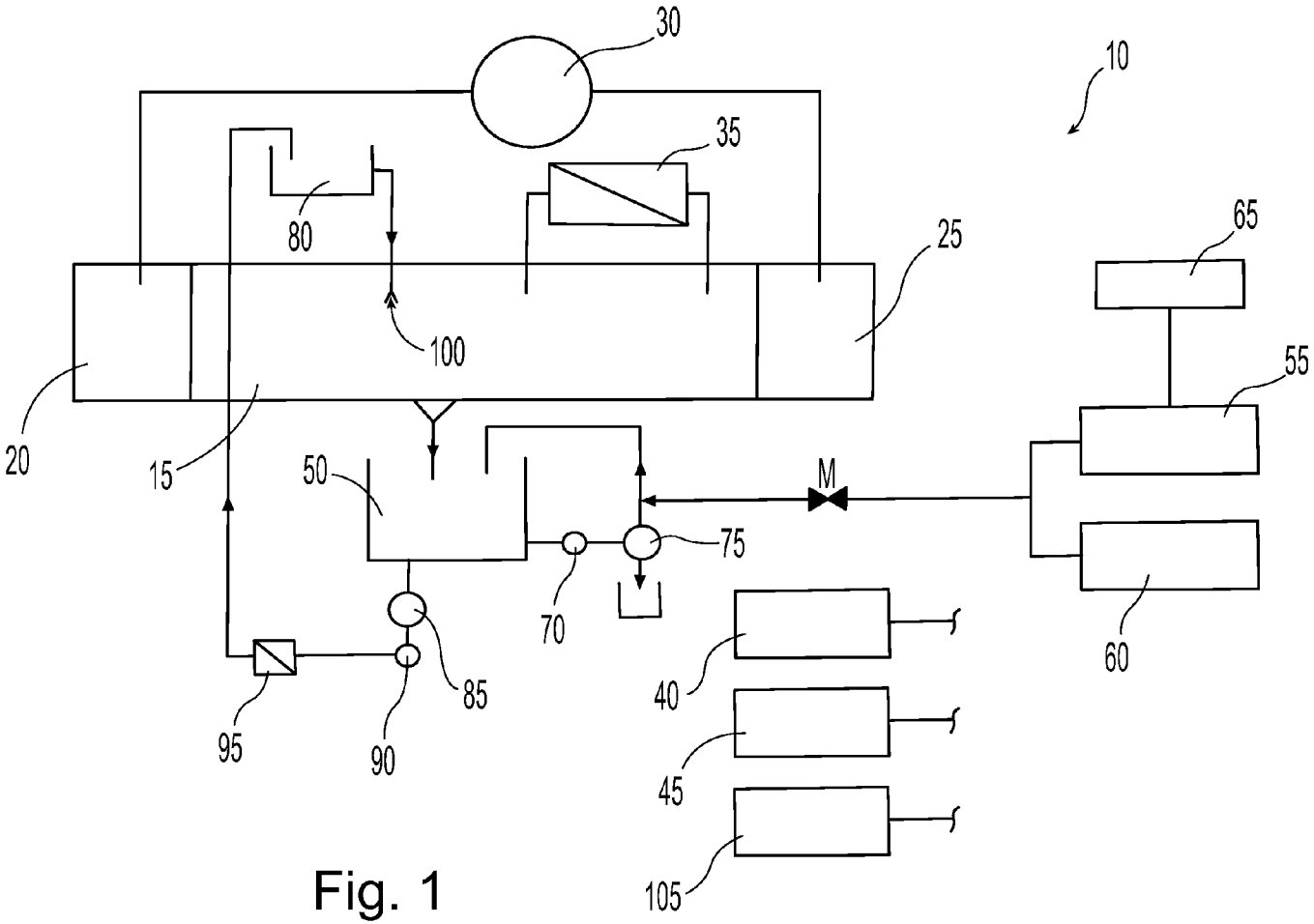
FIG. 1 is a schematic diagram illustrating various components comprising one embodiment of the system of the present invention.

A schematic representation of various components of one embodiment of the adhesion promoter application system 10 of the present invention can be seen in FIG. 1. A treatment enclosure 15, which may be a portion of a larger pretreatment enclosure, provides a captive environment for the application of the adhesion promoter to particular thermoplastic polyolefin (TPO) elements (not shown).

The treatment enclosure 15 is preferably closed at its entrance by a first air seal 20, and at its exit by a second air seal 25. A fan 30 may provide the air supply necessary to maintain the air seals 20, 25. The TPO elements are preferably cooled prior to entering the treatment enclosure 15, thus, the first air seal 20 helps to prevent cool air from entering the treatment enclosure. A pre-oven is preferably connected to the exit portion of the treatment enclosure 15. Similar in function to the first air seal 20, the second air seal 25 helps to prevent hot air from the pre-oven from entering the treatment enclosure 15. An air temperature and humidity conditioner 35 is preferably provided to maintain the atmospheric conditions within the treatment enclosure 15. A chiller 40 and a boiler 45 are provided to supply cooled and heated water, respectively, to the air temperature and humidity conditioner 35.

A supply tank 50 is preferably utilized to maintain a source of an adhesion promoter for use by the system 10. A stock of adhesion promoter 55 and a supply of de-ionized water 60 are preferably in metered communication with the supply tank 50. The adhesion promoter stock 55 is further metered and controlled by a surface tension meter 65. The surface tension meter 65 is adapted to analyze a wet sample of adhesion promoter, and thereby control the amount of adhesion promoter and solvent that is supplied to the supply tank 50. A re-circulation pump 70 is preferably used to re-circulate the adhesion promoter through an ultra-filtration module 75 for removing particulate contamination.

The adhesion promoter in the supply tank 50 is preferably supplied to a gravity tank 80 by means of a supply pump 85. The adhesion promoter preferably passes through a supply filter 90, and also passes through a heat exchanger 95 on its way to the gravity tank 80. The heat exchanger 95 operates to adjust the temperature of the adhesion promoter traveling to the gravity tank 80. Preferably, the temperature of the adhesion promoter in the gravity tank is maintained at between about 20-25° C. The chiller 40 and boiler 45 also supply cooled and heated water, respectively, to the heat exchanger 95.

From the gravity tank 80, the adhesion promoter is preferably directed to a multitude of nozzles 100 within the treatment enclosure 15 for application to the passing TPO elements. The temperature of the adhesion promoter may be monitored within the gravity tank 80 and the flow rate may be monitored at the nozzle 100 outlets to ensure proper application to the TPO elements. Operation and monitoring of the system 10 may be conducted via an operator/electrical panel 105.

Alternate embodiments may also be possible. For example, the stock of adhesion promoter 55 and supply of de-ionized water 60 may be supplied directly to the gravity tank 80 or directly to the nozzles 100. Alternatively, the supply tank 50 may be used without the gravity tank 80, whereby the adhesion promoter may be supplied directly from the supply tank to the nozzles 100.

Figure 2:
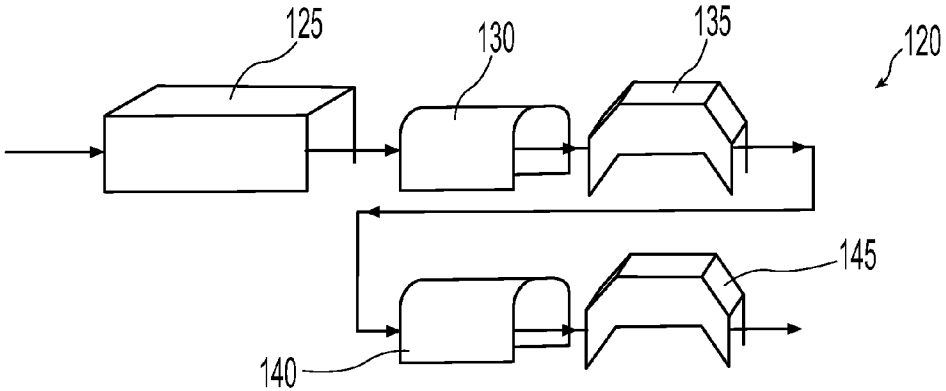
Fig. 2 (Prior Art)
FIG. 2 is a pictorial diagram depicting a typical prior art TPO component coating system.

FIG. 2 illustrates a known TPO element coating process 120. TPO elements traveling in a direction indicated by the arrows first enter a pretreatment enclosure 125. Within the pretreatment enclosure 125, the elements are subjected to a washing/degreasing process, and typically, to a surface conditioning operation. Upon exiting the pretreatment enclosure 125, the TPO elements enter a primer booth 130, where a coat of primer is applied to promote adhesion between the TPO element and a later applied base coat. The primed TPO elements are then passed through a primer oven 135 in order to fully dry the primer coat. After the primer coat is fully dried in the primer oven 135, the TPO elements enter a paint booth 140, where they receive a base (color) coat and possibly a clear coat. The base coat, and if applicable the clear coat, are then dried in a paint oven 145 prior to their availability for final use.

Figure 3:
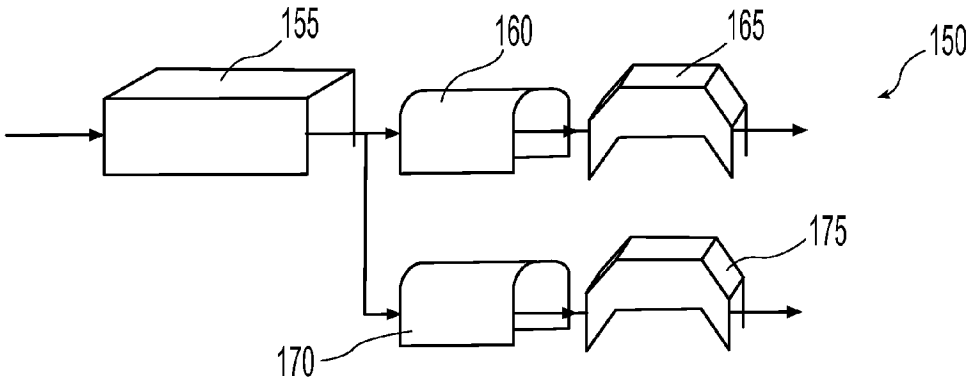
FIG. 3 is a pictorial diagram depicting an embodiment of the TPO component coating process disclosed by the present invention.

An overview of the TPO element coating process 150 of the present invention can be seen by reference to FIG. 3. In the present invention the TPO elements, traveling in the direction of the arrows, enter a pretreatment enclosure 155. Within the pretreatment enclosure 155, the TPO elements preferably undergo a washing/degreasing process and are then subjected to application of the adhesion promoter in a treatment section of the enclosure. Because the adhesion promoter allows a base coat to be applied directly to the adhesion promoter-treated surface of the TPO elements, the need for a primer booth and primer oven is obviated. Therefore, as shown in FIG. 3, upon exiting the pretreatment enclosure 155, the TPO elements may enter directly into a paint booth 160, where they receive a base (color) coat and possibly a clear coat. The base coat, and if applicable the clear coat, are then dried in a paint oven 165 prior to their availability for final use.

Another advantage to the process of the present invention is depicted in FIG. 3. Because no primer booth or primer oven is required, at least one additional paint booth 170 and paint oven 175 may be available for receiving adhesion promoter-treated parts. The additional paint booth 170 and paint oven 175 may be created by converting a pre-existing primer booth and primer oven, for example. Thus, the adhesion promoter application system and process of the present invention may also serve to double the production capacity of the TPO element paint process.

Figure 4:
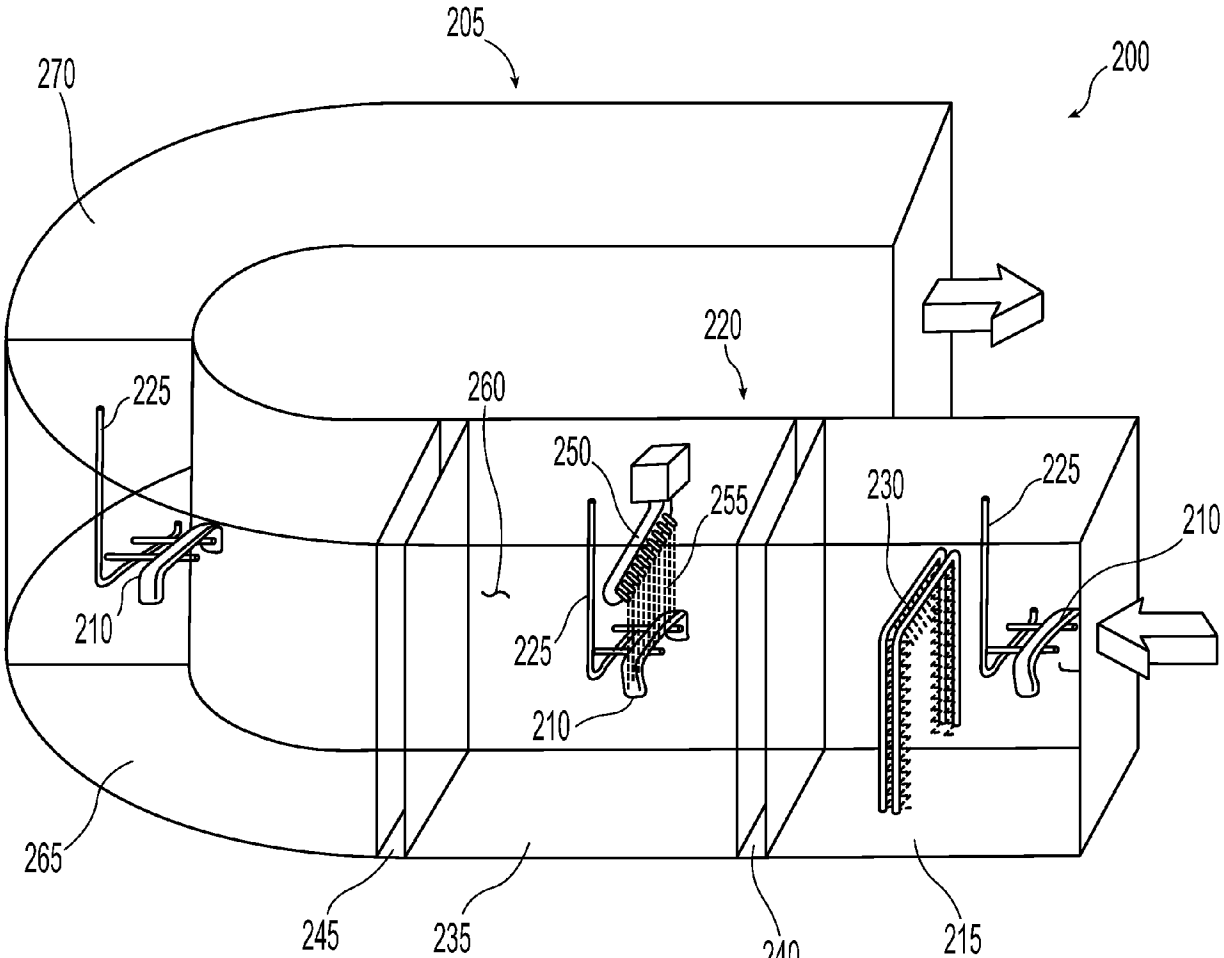
FIG. 4 graphically illustrates the stages of one embodiment of the adhesion promoter application process of the present invention.

A graphical representation of the various stages of an embodiment of the adhesion promoter application process 200 of the present invention can be seen in FIG. 4. For purposes of clarity, the enclosure portion of the system is represented as transparent. It should also be noted that although a carrier 225 is shown in FIG. 4 to hold only one TPO element 210, it is possible, and typically desirable that each carrier transport multiple elements.

The TPO element 210, represented in this embodiment as an automobile bumper fascia, can be seen near a cooling portion 215 of a pretreatment enclosure 220. As represented in this position, the TPO element 210 has already been subjected to a washing/degreasing operation in a more forward portion (not shown) of the pretreatment enclosure 220.

Because the temperature of the TPO element 210 has likely become elevated during the washing/degreasing operation, the TPO element is transported in the direction of the arrows by the carrier 225, and through a cooling device 230. For purposes of illustration, the cooling device 230 may be a series of nozzles spraying cooled, de-ionized water, as represented here, but other embodiments are also possible that can produce the desired effect. The cooling device 230 preferably reduces the temperature of the TPO element 210 to approximately that of the adhesion promoter application section 235 of the pretreatment enclosure 220. Cooling of the TPO element 210 is desirable to prevent heat transfer from the TPO element to the atmosphere within the adhesion promoter application section 235 of the pretreatment enclosure 220.

A first air seal 240, preferably created by a fan 30 (FIG. 1), assists in preventing the atmosphere of the cooling portion 215 of the pretreatment enclosure 220 from influencing the atmosphere within the adhesion promoter application section 235. The temperature of the first air seal 240 is preferably maintained at approximately the desired interior temperature of the adhesion promoter application section 235 of the pretreatment enclosure 220.

The TPO element 210 and carrier 225 pass through the first air seal 240 and into the adhesion promoter application section 235 of the pretreatment enclosure 220. A second air seal 245 separates the adhesion promoter application section 235 of the pretreatment enclosure 220 from a pre-oven 265. At a point preferably nearer the first air seal 240, an application portion 250 (FIGS. 5-7) of the adhesion promoter application system applies the adhesion promoter 255 to the TPO element 210. The linear velocity of the carrier 225 and TPO element 210 during application of the adhesion promoter is preferably between approximately 1-5 meters per minute, and in one example embodiment, is approximately 1.2 meters per minute.

The remaining segment of the adhesion promoter application section 235 of the pretreatment enclosure 220 located between the application portion 250 and the second air seal 245 is used as a setting zone 260. The setting zone 260 allows at least a portion of the adhesion promoter to flash off of the TPO element 210 before entering the pre-oven 265. Preferably, the adhesion promoter application section 235 of the pretreatment enclosure 220 is maintained at a temperature of between about 20-25° C. and a relative humidity of between approximately 40-70%.

Upon exiting the adhesion promoter application section 235 of the pretreatment enclosure 220 through the second air seal 245, the TPO element 210 preferably enters a pre-oven 265, where the temperature of the TPO element and the remaining adhesion promoter is elevated prior to entering a drying oven 270. The temperature may vary from between approximately 25-65° C., and the relative humidity may vary from between about 15-60% depending on the location of the TPO element 210 within the pre-oven 265.

The adhesion promoter remaining on the TPO element 210 is preferably further dried in the drying oven 270 prior to entering a paint booth 160, 170 (FIG. 3). The temperature may vary from between approximately 45-95° C., and the relative humidity may vary from between about 5-25% depending on the location of the TPO element 210 within the drying oven 270.

Figure 5:
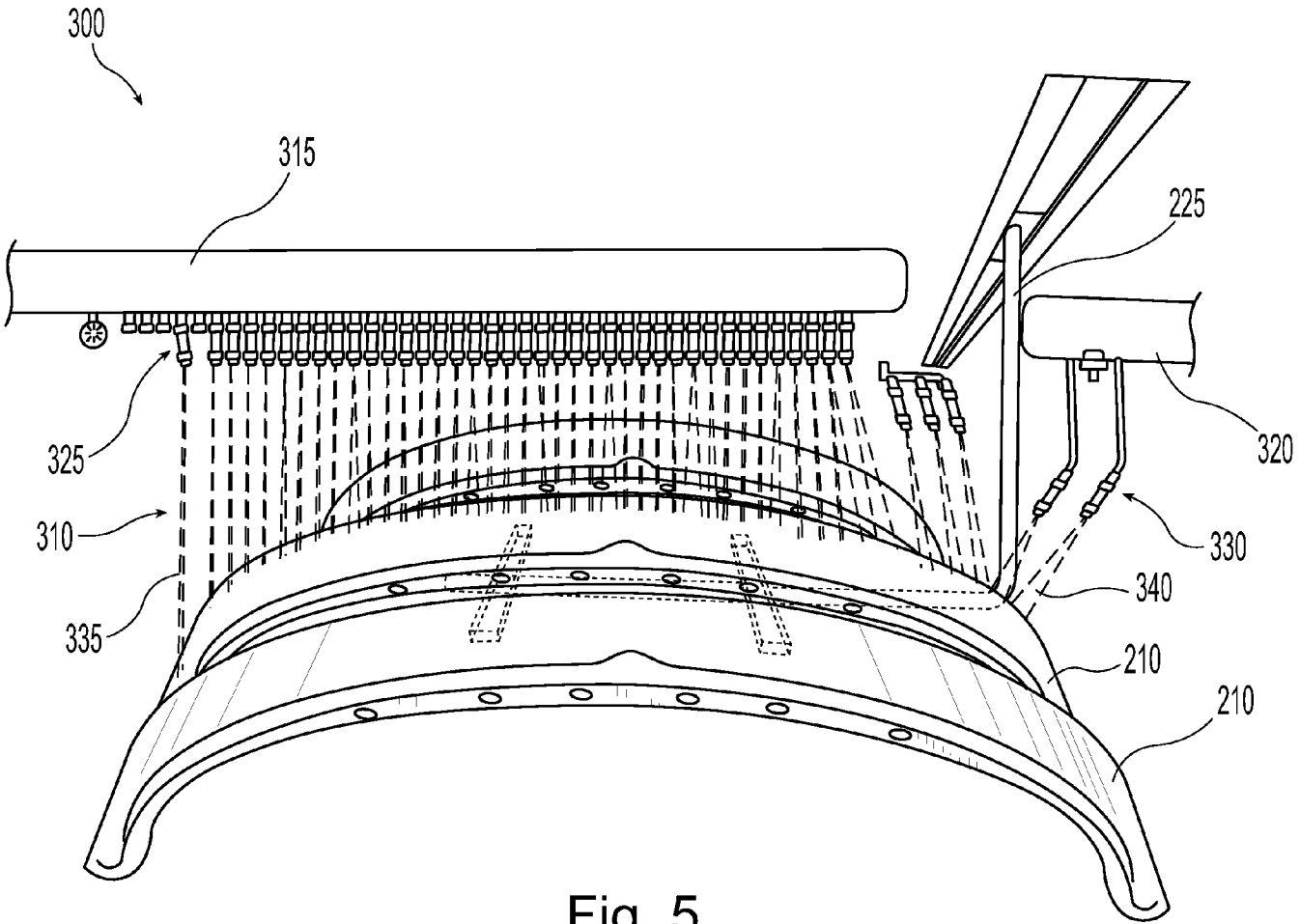
FIG. 5 is an enlarged front view, showing a series of TPO components passing through an application portion of one embodiment of the adhesion promoter application system of the present invention.

An enlarged, frontal view of an embodiment of the application portion 300 of the adhesion promoter application system is shown in FIG. 5. Multiple TPO elements 210 can be seen to be placed in communication with a supply of an emitted adhesion promoter 310 by the carrier 225. In this embodiment, the adhesion promoter 310 is supplied, preferably via a gravity tank (not shown), to a main and secondary supply header 315, 320. The use of a gravity tank helps to prevent foaming of the adhesion promoter 310 as it contacts the TPO elements 210, by reducing the amount of air trapped therein. It has been found that excessive foaming may lead to defects, such as streaks, runs, and sags in the layer of adhesion promoter deposited on the TPO elements 210.

Each of the main and secondary supply headers 315, 320 are shown to have multiple nozzles 325, 330 for distributing the adhesion promoter 310 upon the TPO elements 210 passing underneath. Although the number of nozzles 325, 330 may vary, good results have been achieved by using between about 15-30 total nozzles.

The nozzles may be of differing configuration to allow for various adhesion promoter 310 distribution patterns. Various shapes, such as a stream 335 or a fan pattern 340, for example, may be employed to most appropriately distribute the adhesion promoter 310 about the TPO components 210 without causing defects.

Each of the nozzles 325, 330 preferably also possesses its own flow control device (not shown). The flow control device may be a manual valve, or an electronic solenoid operated valve, for example. The use of a flow control device is preferred, as it has been found that the flow rate of the adhesion promoter 310 can affect the quality of the final adhesion promoter layer that will remain on each of the TPO components 210. Satisfactory results have been achieved using an adhesion promoter flow rate of between approximately 0.5-2.5 liters per minute, and in one example embodiment, the adhesion promoter flow rate is approximately 1.5 liters per minute.

Figure 6:
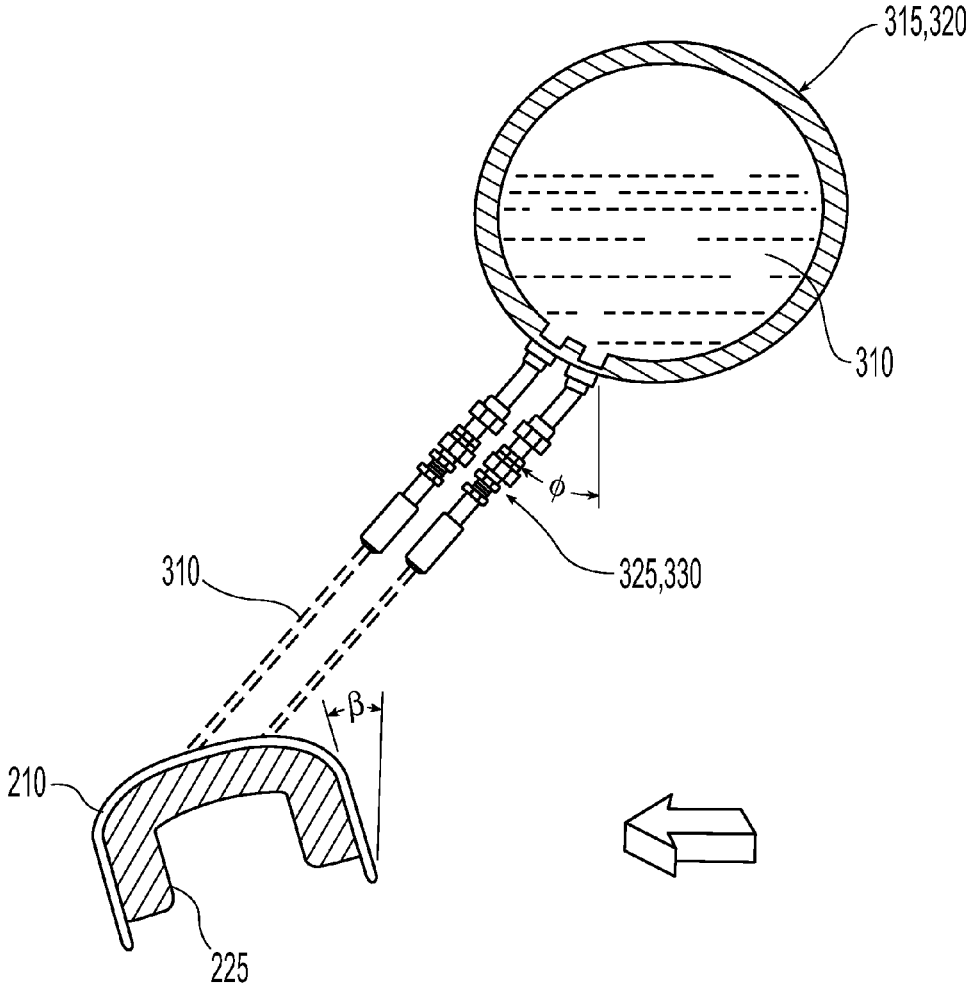
FIG. 6 is an enlarged side view, in partial cross-section, depicting several components of the application portion of the embodiment of the adhesion promoter application system shown in FIG. 5.

FIG. 6 is an enlarged side view, in partial cross-section, which illustrates the supply headers 315, 320 and nozzles 325, 330 of FIG. 5 in more detail. A cross-section of typical header 315, 320 construction is shown to be partially filled with the adhesion promoter 310. The headers 315, 320 may be manufactured of various materials, such as, for example, PVC pipe. The nozzles 325, 330 extend from the headers 315, 320 and are in communication with the adhesion promoter 310 located therein. The nozzles 325, 330 may be constructed of various types and sizes of pipe or tubing, and are preferably manufactured of a plastic or stainless steel material. As discussed above, it is also preferable that the nozzles 325, 330 possess some type of flow control (not shown).

As can be seen, the nozzles 325, 330 are preferably angled in the direction of travel of the TPO elements 210, which direction is indicated by the arrow. Delivering the adhesion promoter 310 through an angled nozzle 325, 330 appears to reduce the force of impact on the TPO element 210 by the adhesion promoter, thereby reducing foaming and subsequent adhesion promoter layer defects. Although the optimum angle ø of the nozzles may vary depending on the configuration of the TPO element 210 to which the adhesion promoter 310 is to be applied, good results have been obtained utilizing a nozzle angle ø of between about 10-45 degrees relative to vertical. However, based upon factors such as TPO element configuration, TPO element linear velocity, adhesion promoter flow rate, and nozzle to element distance, for example, lesser or greater nozzle angles may also give satisfactory results.

As also shown in FIG. 6, it may be preferable to position the TPO element 210 at an angle β as it passes beneath the adhesion promoter 310. In the embodiment of FIG. 6, the TPO element 210 is shown to be angled on the carrier 225, toward its direction of travel and away from the nozzles 325, 330. It has been found that orienting the TPO element 210 as shown may reduce the amount or severity of defects appearing in the adhesion promoter layer that remains on the TPO element after drying. As with the nozzle angle ø discussed above, the optimum angle β of TPO element 210 orientation on the carrier 225 will depend largely on the configuration of the TPO element and other application parameters. However, good results have been achieved for the embodiment illustrated in FIG. 6 by orienting the TPO element 210 on the carrier 225 at an angle β of between about 5-20 degrees, and more preferably about 12 degrees from vertical, in a direction away from the nozzles 325, 330.

Figure 7:
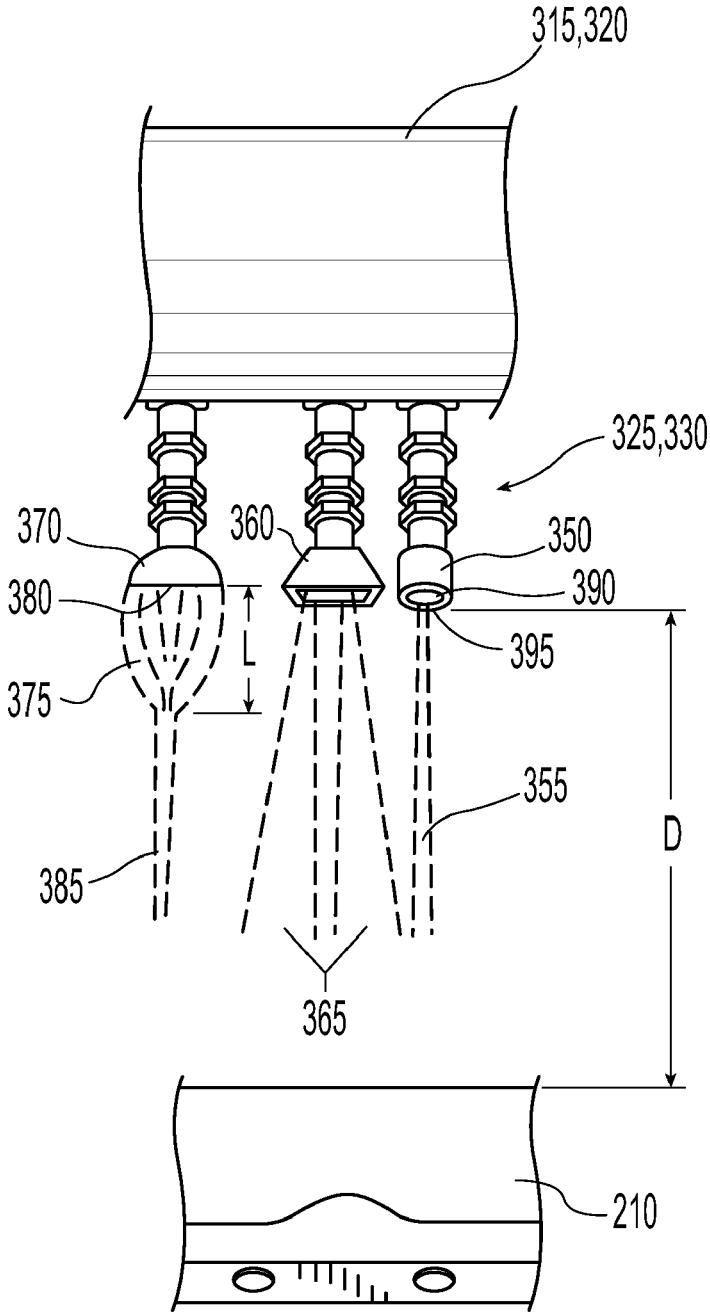
FIG. 7 illustrates alternate embodiments of adhesion promoter application nozzles utilized in the present invention.

Now referring to FIG. 7, a frontal, detailed view of the nozzles 325, 330 of FIGS. 5 and 6 can be seen. Three different types of nozzles 325, 330 are shown to extend from the supply header 315, 320. A single stream nozzle 350 is shown on the right. The single stream nozzle 350 is adapted to deliver an adhesion promoter stream 355 of substantially uniform diameter to the TPO element 210. A dispersion nozzle 360 can be seen in the middle position. The dispersion nozzle 360 is designed to apply a wider pattern 365 of the adhesion promoter to the TPO element 210. A fan nozzle 370 can be seen on the left. The fan nozzle 370 preferably has a thin opening 380 of between approximately 20-30 millimeters in width, which causes the adhesion promoter 310 to exit the nozzle in substantially a fan pattern 375.

Depending on the distance between the nozzles 325, 330 and the TPO element 210, the length L of the fan portion 375 of the adhesion promoter stream 385 is preferably between about 10-150 millimeters.

A variety of nozzle diameters 390 may be employed to adequately expel the adhesion promoter 310. However, for the embodiments illustrated in FIGS. 5-7, the best results have been achieved by using a nozzle diameter of between approximately 0.25-0.50 inches, with a nozzle opening diameter 395 of between about 0.5-1.0 millimeters.

It has been discovered through experimentation that the distance D between the nozzles 325, 330 and the surface of the TPO element 210 also may have bearing on the quality of the adhesion promoter layer that will be deposited thereon. As with flow rate and angle of impact, it appears that the distance D between the nozzles 325, 330 and the surface of the TPO element 210 affects the amount of splashing and foaming of the adhesion promoter 310 that will occur. Depending on adhesion promoter flow rate, linear speed of the TPO elements 210, and TPO element configuration, a distance D of between approximately 0.25-14 inches has yielded acceptable results. For the embodiments shown in FIGS. 5-7, however, a distance D of approximately 1.75 inches is preferable. Due to variations in distance D that may be required between different TPO elements, it is preferable that a part collision detection limit switch means be employed to ensure that a TPO element is not able to collide with any of the nozzles 325, 330.

Figure 8:
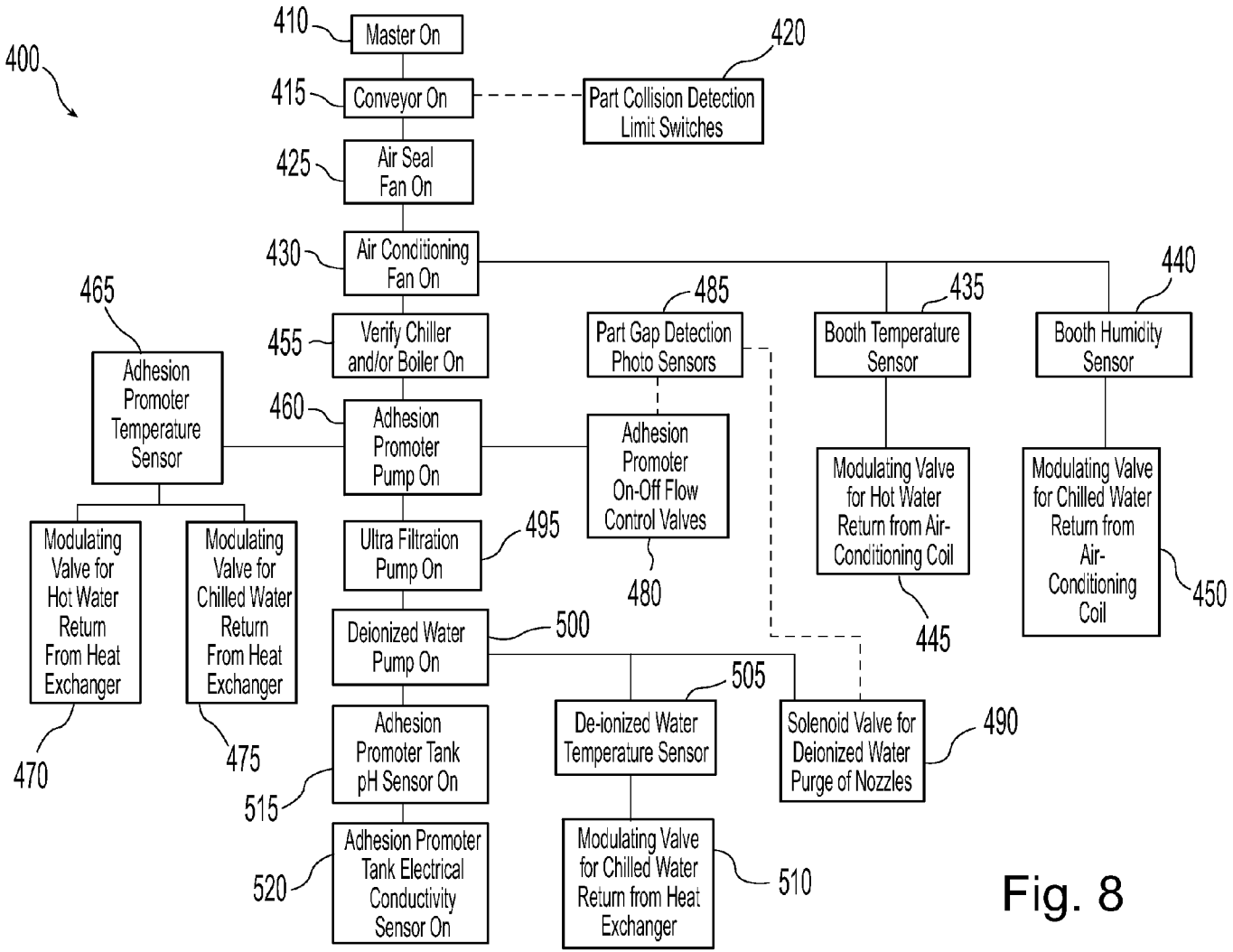
FIG. 8 is a schematic diagram detailing the operating procedure of a particular embodiment of the present invention.

The operating procedure of a particular embodiment of the present invention can be seen in the diagram of FIG. 8. A master on switch 410, which delivers electrical power to the system, is first activated. Electrical power is then in turn applied, either by manual activation or automatically, to: the TPO element conveyor 415, which is constrained via an interlock to check the condition of one or more part collision detection limit switches 420; the air seal fan 425; and the air conditioning (atmosphere control) fan 430. Upon activation of the air conditioning fan 430, a signal is sent from both an enclosure temperature sensor 435 and an enclosure humidity sensor 440. The enclosure temperature sensor 435 and enclosure humidity sensor 440 are in respective communication with a modulating valve for the hot water return from the air-conditioning coil 445 and a modulating valve for the chilled water return from the air-conditioning coil 450. This allows for automatic control of the temperature and relative humidity within the enclosure 15. A check is then made to verify that both the chiller and boiler are operational 455.

Next, electrical power is applied to a pump for supplying the adhesion promoter 460. Upon activation of the adhesion promoter pump 460, an adhesion promoter tank temperature sensor 465, which is in communication with both a modulating valve for the hot water return from the heat exchanger 470 and a modulating valve for the chilled water return from the heat exchanger 475, operates to maintain the desired temperature of the adhesion promoter. Activation of the adhesion promoter pump 460 also triggers a check of adhesion promoter on/off flow control valves 480, and part-gap detection photo sensors 485, which evaluate the position of the adhesion promoter application nozzles in relation to the TPO elements to be treated. The adhesion promoter on/off flow control valves 480 are also interconnected to a solenoid valve for de-ionized water nozzle purging 490, which periodically provides de-ionized water to the nozzles to prevent the build-up of adhesion promoter.

A filtration pump 495 and a de-ionized water pump 500 are then turned on. The energizing of the de-ionized water pump 500 activates a de-ionized water temperature sensor 505. The de-ionized water temperature sensor 505 is in communication with the modulating valve for the chilled water return from the heat exchanger 510, which allows the temperature sensor 505 to control the temperature of the de-ionized water supply that may be used, among other things, to rinse and cool the TPO elements prior to application of the adhesion promoter.

An adhesion promoter tank pH sensor is next activated 515, along with an adhesion promoter tank electrical conductivity sensor 520. The pH sensor 515 and the conductivity sensor 520 allow the properties of the adhesion promoter to be monitored.

The scope of the invention is not to be considered limited by the above disclosure, and modifications are possible without departing from the spirit of the invention as evidenced by the following claims:

What is claimed is:

1. An adhesion promoter application system for coating thermoplastic polyolefin elements with a layer of adhesion promoter having minimal defects, comprising:

a plurality of carriers for moving said thermoplastic polyolefin elements through said system with each polyolefin element angled from vertical toward the direction of travel of said carrier;

a device for mixing an adhesion promoter with de-ionized water to form a mixture;

a storage device for storing a supply of said mixture;

an enclosure for providing a protected environment during application of said mixture to thermoplastic polyolefin elements located therein;

an adhesion promoter application device within said enclosure for flowing said mixture with minimum agitation over said thermoplastic polyolefin elements, said adhesion promoter application device further comprising:

a gravity tank for holding a supply of said mixture;

at least one mixture supply header in communication with said gravity tank and located overhead of said moving thermoplastic polyolefin elements, a plurality of gravity-fed mixture dispensing nozzles extending downward from said at least one mixture supply header toward said thermoplastic polyolefin elements and distributed along the length thereof such that a paintable surface of said thermoplastic polyolefin elements is coatable by said nozzles, said nozzles angled in the direction of travel of said carriers, and a flow regulation means for regulating the flow rate of said mixture through each nozzle;

a pump for supplying said mixture from said storage device to said gravity tank;

an atmosphere controller for regulating the atmosphere within said enclosure; and a drying device for drying said mixture after application to said thermoplastic polyolefin elements;

wherein agitation of said mixture during application thereof to said thermoplastic polyolefin elements is minimized by use of said adhesion promoter application device, thereby reducing or eliminating defects in a dried layer of adhesion promoter that remains on said thermoplastic polyolefin elements after said thermoplastic polyolefin elements pass through said drying device.

2. The application system of claim 1, wherein the angle of each nozzle can be adjusted.

3. The application system of claim 1, wherein said thermoplastic polyolefin elements are angled between about 5-20 degrees relative to vertical.

4. The application system of claim 1, wherein said nozzles are angled between about 10-45 degrees relative to vertical in the direction of travel of said carriers.

5. The application system of claim 1, further comprising a re-circulation pump for re-circulating said mixture.

6. The application system of claim 1, further comprising a cleaning device for removing contaminants from said thermoplastic polyolefin elements prior to application of said mixture.

7. The application system of claim 1, wherein said enclosure also houses said cleaning device, said cleaning device occurring prior to said adhesion promoter application device with respect to the path of travel of said thermoplastic polyolefin elements.

8. The application system of claim 7, further comprising at least a partial seal for separating said enclosure portion housing said cleaning device from said enclosure portion housing said adhesion promoter application device.

9. The application system of claim 1, wherein the amount of said adhesion promoter mixed with said de-ionized water is regulated by a metering device.

10. The application system of claim 9, wherein a surface tension meter is adapted to analyze a wet sample of said mixture, said surface tension meter further adapted to communicate with said metering device for providing regulation of the amount of said adhesion promoter added to said de-ionized water based on said analysis.

11. The application system of claim 1, wherein said adhesion promoter consists essentially of:

a grafted polypropylene chloride;

an amine-neutralized water-soluble resin; and a wettability-improving agent.

* * * * *

UNITED STATES PATENT AND TRADEMARK OFFICE

CERTIFICATE OF CORRECTION

PATENT NO. : 7,238,235 B2
APPLICATION NO. : 11/286465
DATED : July 3, 2007
INVENTOR(S) : Bhattacharya et al.

It is certified that error appears in the above-identified patent and that said Letters Patent is hereby corrected as shown below:

In claim 1 column 8, line 24, after "polyolefin element" please insert -- and at least a polyolefin element supporting portion of said carrier --.

In claim 7 column 9, line 13, please delete "The application system of claim 1" and insert -- The application system of claim 6 --.

In claim 8 column 9, lines 18-19, and column 10, lines 1-2, please delete the text of claim 8 and insert -- The application system of claim 7, further comprising at least a partial seal for separating a portion of said enclosure housing said cleaning device from another portion of said enclosure housing said adhesion promoter application device. --.

Signed and Sealed this

Fourteenth Day of August, 2007

JON W. DUDAS
*Director of the United States Patent and Trademark Office*